US006940418B2

(12) United States Patent
Blum et al.

(10) Patent No.: US 6,940,418 B2
(45) **Date of Patent: *Sep. 6, 2005**

(54) ELECTRONIC FLOOR DISPLAY CLEANING SYSTEM AND PROTECTIVE COVER

(75) Inventors: Ronald D. Blum, Roanoke, VA (US); Joseph Thibodeau, Roanoke, VA (US); William Kokonaski, Gig Harbor, WA (US)

(73) Assignee: Intellimats, LLC, Roanoke, VA (US)

( * ) Notice: Subject to any disclaimer, the term of this patent is extended or adjusted under 35 U.S.C. 154(b) by 42 days.

This patent is subject to a terminal disclaimer.

(21) Appl. No.: 10/373,191

(22) Filed: Feb. 26, 2003

(65) Prior Publication Data

US 2003/0177679 A1 Sep. 25, 2003

Related U.S. Application Data

(63) Continuation-in-part of application No. 10/285,639, filed on Nov. 1, 2002, which is a continuation of application No. 10/137,357, filed on May 3, 2003, now Pat. No. 6,507,285, which is a continuation of application No. 09/767,846, filed on Jan. 24, 2001, now Pat. No. 6,417,778, which is a continuation of application No. 09/418,752, filed on Oct. 15, 1999, now abandoned, which is a continuation-in-part of application No. 09/304,051, filed on May 4, 1999, now Pat. No. 6,219,876.

(60) Provisional application No. 60/361,066, filed on Mar. 1, 2002.

(51) Int. Cl.[7] ..... G08B 5/00

(52) U.S. Cl. ..... 340/815.4; 15/215

(58) Field of Search ..... 340/815.4, 693.5, 340/693.9, 666, 540, 541, 552, 691.6; 15/215

(56) References Cited

U.S. PATENT DOCUMENTS

| | | | |
|---|---|---|---|
| 2,191,704 | A | 2/1940 | Bennett |
| 2,254,830 | A | 9/1941 | Schlose |
| 2,282,672 | A | 5/1942 | Nelson |
| 2,512,310 | A | 6/1950 | Corson |

(Continued)

FOREIGN PATENT DOCUMENTS

| | | |
|---|---|---|
| DE | 3147113 A1 | 11/1981 |
| DE | 3 147 113 | 6/1983 |
| DE | 87 01 817 | 4/1987 |
| DE | 3 923 959 | 10/1990 |
| DE | 3 915 254 | 11/1990 |
| DE | 40 06 781 | 9/1991 |
| DE | 4135877 | 5/1993 |
| DE | 298 11 821 | 10/1998 |
| EP | 0 009 891 | 4/1980 |
| EP | 0 188 005 | 7/1986 |

(Continued)

OTHER PUBLICATIONS

US 6,064,526, 7/2000, Blotky et al. (withdrawn)

(Continued)

*Primary Examiner*—Thomas Mullen
(74) *Attorney, Agent, or Firm*—Kenyon & Kenyon

(57) ABSTRACT

Embodiments of the present invention relate to an electronic display associated with a floor. The electronic display is provided with a sturdy protective cover to prevent damage to the display due to foot traffic or other factors. The protective cover in turn is provided with a device for at least one of preventing damage to the protective cover and for removing dirt from over the electronic display that may obscure the display.

31 Claims, 6 Drawing Sheets

U.S. PATENT DOCUMENTS 2,800,215 A 7/1957 Converse
2,843,868 A 7/1958 Borgstrom
2,919,456 A 1/1960 Spivey
3,078,490 A 2/1963 Etcher
3,083,393 A 4/1963 Nappi
3,141,522 A 7/1964 Fitzpatrick
3,183,116 A 5/1965 Schear
3,300,275 A 1/1967 Lorman
3,400,421 A 9/1968 Nappi et al.
3,435,481 A 4/1969 Kessler
3,501,797 A 3/1970 Nappi
3,517,407 A 6/1970 Wyant
3,578,738 A 5/1971 Hughes
3,663,980 A 5/1972 Conklin
3,665,543 A 5/1972 Nappi
3,696,459 A 10/1972 Kucera et al.
3,699,928 A 10/1972 Stockl
3,717,897 A 2/1973 Amos et al.
3,785,102 A 1/1974 Amos
3,886,620 A 6/1975 Miller
3,906,578 A 9/1975 Huber
3,909,996 A 10/1975 Ettlinger, Jr. et al.
3,916,401 A 10/1975 Freeman
3,930,084 A 12/1975 Shields ..... 428/67
4,107,811 A 8/1978 Imsande
4,126,854 A 11/1978 Sheridon
4,143,103 A 3/1979 Sheridon
4,143,194 A 3/1979 Wihksne
4,328,275 A 5/1982 Vargo
4,353,944 A 10/1982 Tarui
4,421,809 A 12/1983 Bish et al.
4,435,451 A 3/1984 Neubert
4,439,474 A 3/1984 Sagel
4,482,593 A 11/1984 Sagel et al.
4,484,260 A 11/1984 Blahut et al.
4,559,250 A 12/1985 Paige
4,564,546 A 1/1986 Jones
4,609,580 A 9/1986 Rockett et al.
4,614,679 A 9/1986 Farrington et al.
4,660,828 A 4/1987 Weiss ..... 482/123
4,665,342 A 5/1987 Topp et al. ..... 313/505
4,707,895 A 11/1987 Lang
4,720,789 A 1/1988 Hector et al.
4,752,114 A 6/1988 French ..... 350/96.24
4,798,754 A 1/1989 Tomek
4,822,669 A 4/1989 Roga
4,853,678 A 8/1989 Bishop, Jr. et al. ..... 340/573
4,917,975 A 4/1990 De Guzman
4,959,265 A 9/1990 Wood
4,974,857 A 12/1990 Beall et al. ..... 273/371
5,018,235 A 5/1991 Stamatiou
5,071,628 A 12/1991 Alazet
5,142,733 A 9/1992 Mogel
5,161,041 A 11/1992 Abileah et al. ..... 359/40
5,204,159 A 4/1993 Tan
5,293,660 A 3/1994 Park
5,335,788 A 8/1994 Beasley et al.
5,344,693 A 9/1994 Sanders
5,460,381 A 10/1995 Smith et al. ..... 273/238
5,461,748 A 10/1995 Koiduka
5,500,267 A 3/1996 Canning
5,556,685 A 9/1996 Swicegood, Jr.
5,561,446 A 10/1996 Montlick ..... 345/173
5,562,580 A 10/1996 Beasley et al.
5,571,626 A 11/1996 Cumming et al.
5,589,246 A 12/1996 Calhoun
5,604,027 A 2/1997 Sheridon
5,613,313 A 3/1997 Homan et al.
5,646,818 A 7/1997 Hahn ..... 361/681
5,658,637 A 8/1997 Volz
5,703,564 A 12/1997 Begum et al. ..... 340/539
5,723,204 A 3/1998 Stefik
5,747,133 A 5/1998 Vinod et al. ..... 428/46
5,805,117 A 9/1998 Mazurek et al. ..... 345/1
5,815,995 A 10/1998 Adam
5,816,550 A 10/1998 Watanabe et al. ..... 248/222.11
5,826,874 A 10/1998 Teitell et al.
5,839,976 A 11/1998 Darr
5,848,830 A 12/1998 Castle et al. ..... 362/84
5,869,350 A 2/1999 Heeger et al.
5,885,684 A 3/1999 Hefner et al. ..... 428/89
5,886,474 A 3/1999 Asai et al. ..... 315/169.1
5,913,727 A 6/1999 Ahdoot ..... 463/39
5,945,502 A 8/1999 Hsieh et al.
5,971,761 A 10/1999 Tillman, Sr. ..... 434/81
6,010,429 A 1/2000 Prueitt
6,219,876 B1 4/2001 Blum
6,233,776 B1 5/2001 Blum et al.
6,247,250 B1 6/2001 Hauser ..... 235/487
6,378,925 B1 4/2002 Greenlee ..... 294/171
6,417,778 B2 7/2002 Blum et al.
6,646,545 B2 * 11/2003 Bligh ..... 340/815.4
2001/0011399 A1 8/2001 Blum et al.

FOREIGN PATENT DOCUMENTS

EP 0 199 537 10/1986
EP 0 202 846 11/1986
EP 0 353 139 1/1990
EP 0 354 281 2/1990
EP 0 359 478 3/1990
EP 0 365 869 5/1990
EP 0 374 860 6/1990
EP 0 421 258 4/1991
EP 0 448 768 10/1991
EP 0 512 904 11/1992
EP 0 514 191 11/1992
EP 0 554 641 8/1993
EP 0 573 277 12/1993
EP 0 624 125 11/1994
EP 0 624 681 11/1994
EP 0 648 834 4/1995
EP 0 721 176 7/1996
EP 0 751 213 1/1997
EP 0 794 244 9/1997
EP 0 839 900 5/1998
EP 0 895 745 2/1999
EP 0 971 064 1/2000
FR 2 532 095 2/1984
GB 319 416 9/1929
GB 433 133 8/1935
GB 2 182 242 5/1987
GB 2 263 003 7/1993
JP 4 144 532 5/1992
JP 6-90891 4/1994
JP 6 189 890 7/1994
JP 8056810 3/1996
JP 08-239988 9/1996
JP 10-057728 3/1998
JP 11-109901 4/1999
JP 2000-105558 4/2000
JP 2002-00059 7/2000
WO 91/08701 6/1991
WO 93/20536 10/1993
WO WO 00/07811 2/2000
WO WO 00/16682 3/2000
WO WO 00/79871 4/2000
WO WO 00/29209 5/2000
WO 01/27909 A1 4/2001
WO WO 02/11110 2/2002
WO WO 02/22972 3/2002
WO WO 02/065451 8/2002

OTHER PUBLICATIONS

Protective Products Advertisement.
Side–Panner Advertisement.
3m Clean–Walk Mat, 5800 Series, Technical Data, Jul. 1995.
Advertising Materials for Alma, (Advanced Laminated Material Applications, Inc.), ClenStep Contamination Control Mat, 12 pages, 1999.
"Displaying a Winning Glow", Michael Kenward, Technology Review, Jan./Feb. 1999, vol. 102, No. 1, 7 pages.
"Screen Saviors", Michael Mattis, Business 2.0, Jul. 1999, 1 page–.
"What's New", "Intelligent Ink", Advertising Material, Popular, 1 page, no date.
"Electronic Ink "., Glen Sanders, ebooknet.com, 2 pages, Sep. 20, 1999.
MMR Journal, "Floor Decals New Wrinkle in P–O–P Ads", vol. 18, No. 10, p. 13, Apr. 5, 1999, USA.
Philadelphia Enquirer, "Cherry Hill, N.J. Firm Wants You To Look Down On Its Ads", Regional Newspaper, Aug. 27, 1998, USA.
"Floor Graphics" advertisements, copyright 2002.
U.K. Patent Office Search report dated May 28, 2003.
Patent Abstracts of Japan, vol. 1995, No. 05, Jun. 30, 1995 & JP 07 036395 A (Toray Ind Inc), Feb. 7, 1995.
Patent Abstracts of Japan, vol. 1997, No. 01, Jan. 31, 1997 & JP 08 239988 (Meitaku Syst:KK), Sep. 17, 1996.
Patent Abstracts of Japan, vol. 2002 & JP 2002 062832 A (Nippon Signal Co Ltd:The), Feb. 28, 2002.
Patent Abstracts of Japan, vol. 1995, No. 01, Feb. 28, 1995 & JP JP 06 299682 A (Jiyonsuton:KK), Oct. 25, 1994.
U.S. co–pending Appl. No. 10/438,923 filed May 16, 2003.
U.S. co–pending Appl. No. 10/454,631 filed Jun. 5, 2003.
U.S. co–pending Appl. No. 10/682,435 filed Oct. 10, 2003.
U.S. co–pending Appl. No. 10/759,167 filed Jan. 20, 2004.

* cited by examiner

ELECTRONIC FLOOR DISPLAY CLEANING SYSTEM AND PROTECTIVE COVER

RELATED APPLICATIONS

This application claims the benefit under 35 USC § 119(e) of U S. provisional application No. 60/361,066, filed Mar. 1, 2002. Further, this application is a continuation-in-part of co-pending application Ser. No. 10/285,639, filed Nov. 1, 2002. Application Ser. No. 10/285,639 is a continuation of application Ser. No. 10/137,357, filed May 3, 2002, and issued as U.S. Pat. No. 6,507,285 on Jan. 14, 2003. Application Ser. No. 10/137,357 is a continuation of application Ser. No. 09/767,846, filed Jan. 24, 2001, and issued as U.S. Pat. No. 6,417,778 on Jul. 9, 2002. Application Ser. No. 09/767,846 is a continuation of application Ser. No. 09/418,752, filed Oct. 15, 1999, and now abandoned. Application Ser. No. 09/418,752 is a continuation-in-part of application Ser. No. 09/304,051, filed May 4, 1999, and issued as U.S. Pat. No. 6,219,876 on Apr. 24, 2001. Each of the foregoing applications/patents is fully incorporated herein by reference.

FIELD OF THE INVENTION

The present invention relates to an electronic display associated with a floor, and more particularly to a system for preventing damage to the electronic display from foot traffic, and for cleaning a protective cover of the electronic display.

BACKGROUND

Floor advertising has become one of the fastest growing segments in store advertising or promotions. An example of a currently known type of floor advertising is a decal that adheres to the floor and conveys some kind of illustrated message. Such an advertising medium is limited, however, by the fact that the message is static and not easily changed. On the other hand, U.S. Pat. No. 6,417,778, which is fully incorporated herein by reference, describes a modifiable electronic display associated with a floor that enables images and text to be easily changed, allowing an advertising message to be quickly adaptable and efficiently targeted. However, because such an electronic display is intended to be used in an area where there can be considerable foot traffic, and, in fact, to be freely walked over, the electronic display is vulnerable to damage ensuing therefrom. Accordingly, the electronic display may be provided with a sturdy transparent protective cover. The protective cover itself, however, is subject to being damaged and constantly dirtied by foot traffic, thus obscuring the underlying display and making it difficult to view clearly. Embodiments of the present invention, described herein, address these concerns.

DETAILED DESCRIPTION

Embodiments of the present invention relate to an apparatus comprising a an electronic display associated with a floor, a protective cover for the electronic display, and a device associated with the protective cover, for at least one of preventing damage to the protective cover and removing dirt from over the electronic display. While for illustrative purposes FIGS. 1–4, 4A and 4B show an electronic display associated with a floor covering, the present invention is not so limited. The scope of "associated with a floor" also extends to embodiments that do not include a floor covering, but are instead associated with a floor in some other fashion. For example, the electronic display could be at least partly received within a recess in a floor, as described in more detail below with reference to FIG. 6.

Figure 1:
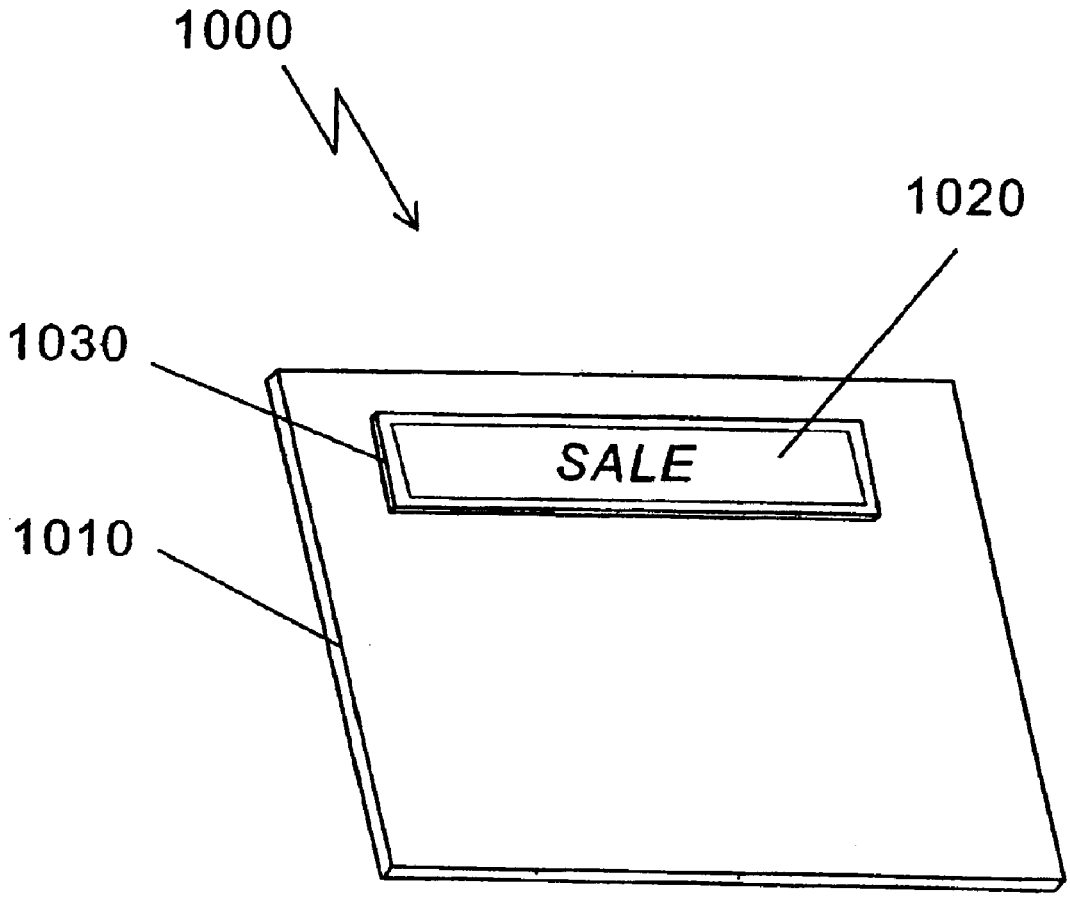
FIG. 1 shows a floor covering with an electronic display having a transparent protective cover according to an embodiment of the present invention.

FIG. 1 illustrates one possible embodiment of the present invention. In FIG. 1, an apparatus 1000 comprises a floor covering 1010, an electronic display 1020 associated with the floor covering 1010, and a protective covering 1030 for the electronic display 1020. The floor covering 1010 may be any kind of structure or layer of material or materials designed to be used in places where there is foot traffic, and may be affixed to a floor or may be portable so that it can be easily moved to different places. The electronic display 1020 may be at least partly connected to, supported by, received within or otherwise associated with the floor covering 1010. The electronic display 1020 may be configured to display graphical images and alphanumeric data in either a static or dynamic (e.g., scrolling or otherwise moving or changing) format. The electronic display 1020 may be connected by wired means or wirelessly to a computer and modifiable via the computer to display any content chosen by a user. The electronic display could be modifiable locally or remotely, such as via a network.

The protective covering 1030 is transparent or semi-transparent to allow the electronic display 1020 to be viewed therethrough, and protects the electronic display 1020 from damage associated with foot traffic, such as scratches, cracks, chips, tears, or damage or obscuration of the display caused by environmental dirt. "Dirt" means any kind of detritus, debris, dust, water, oil, grease or other substance which could be on the underside of a shoe or otherwise transferred to or in the neighborhood of the display. The protective covering 1030 may be sturdy and durable enough that it may be repeatedly stepped on, walked over, or have a shopping cart or other rolling or sliding object traverse it, with negligible effect on the display 1020. The protective covering 1030 could be formed from, for example, tempered glass, laminated glass, or plastics including laminated plastic. Examples of suitable plastics include polycarbonate, acrylic, or any other transparent polymeric material with good mechanical integrity.

Figure 2:
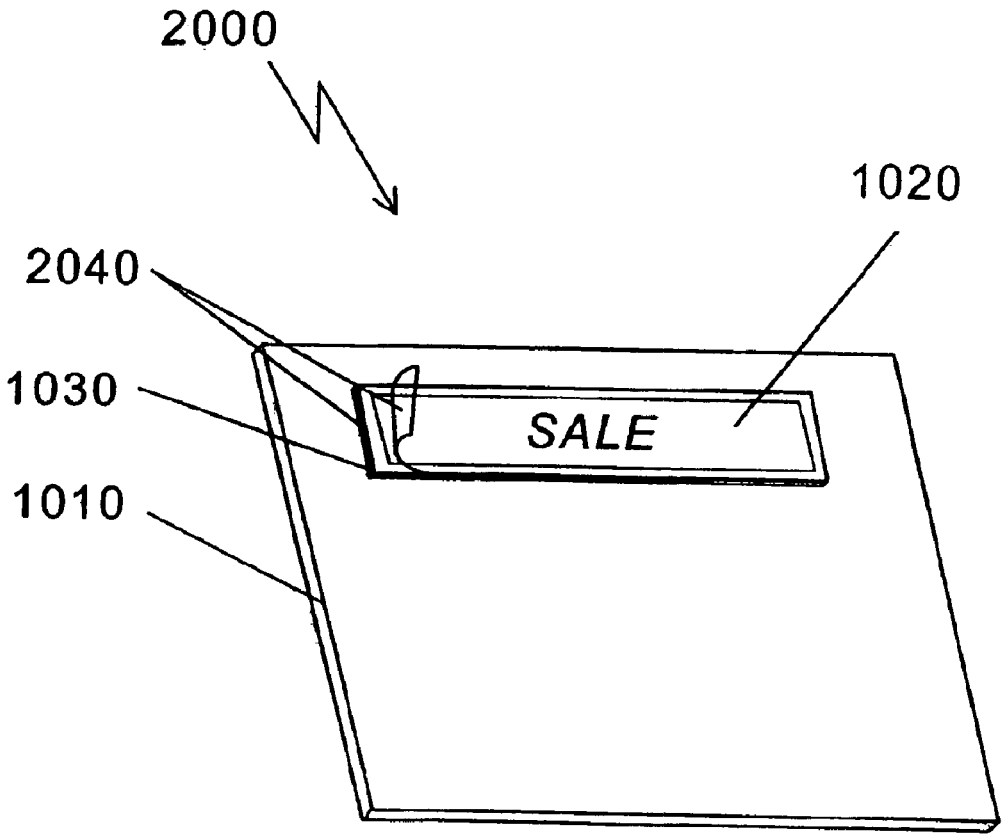
FIG. 2 illustrates an embodiment of the present invention wherein a plurality of separable sheets formed from a protective material are arranged to prevent damage to the protective cover and remove dirt from over the electronic display.

FIG. 2 shows an apparatus 2000 according to further embodiments. The apparatus 2000 comprises a floor covering 1010, display 1020 and protective cover 1030, and further comprises a device 2040 associated with the protective cover 1030, for at least one of preventing damage to the protective cover and removing dirt from over the electronic display. In the embodiment of FIG. 2, the device 2040 comprises a plurality of separable sheets formed from a protective material. The protective material is transparent or semi-transparent and may be formed from, for example, plastic. Examples of types of plastic that could be used to form the protective material include polyethylene, polypropylene, bi-directional polypropylene, polyvinyl chloride, polystyrene, polyester, polyolefin, and various blends or co-polymers of this kind. The plurality of sheets 2040 could be formed as a stack and consist of as few as two sheets or as many as several hundred. The stack of sheets may include an adhesive surface on an underside thereof to enable it to adhere to the protective cover 1030.

When a top exposed sheet of the stack 2040 becomes dirty, for example due to foot traffic, it may be removed from the stack and discarded. Removing the top exposed sheet removes any dirt thereon that may be obscuring the electronic display 1020, allowing any image or alphanumeric information of the display to be clearly viewed through the remaining sheets of the stack. Once all of the sheets of a stack are used, a new stack of multiple sheets may be placed on the display.

Figure 3:
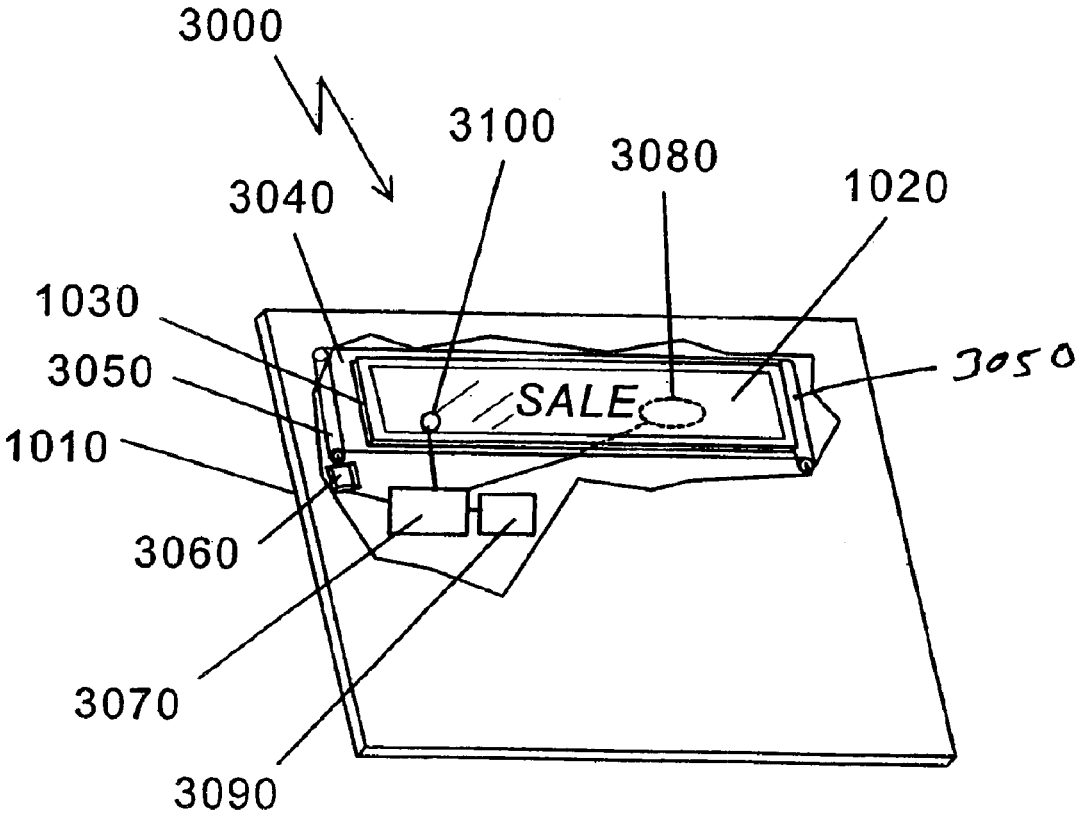
FIG. 3 illustrates an embodiment of the present invention wherein a continuous roll of protective material for preventing damage to the protective cover and removing dirt from over the electronic display may be automatically advanced.

FIG. 3 shows an apparatus 3000 according to still further embodiments of the invention, in a partial sectional view. The apparatus 3000 comprises a floor covering 1010, display 1020 and protective cover 1030, and further comprises a device associated with the protective cover 1030, for at least one of preventing damage to the protective cover and removing dirt from over the electronic display 1020. In the embodiment of FIG. 3, the device comprises a continuous roll of protective material 3040 arranged over a surface of the protective cover 1030. The protective material is transparent or semi-transparent and may be formed from, for example, plastic, such as polyethylene, polypropylene, bi-directional polypropylene, polyvinyl chloride, polystyrene, polyester, polyolefin, various blends or co-polymers and the like. The material 3040 may be arranged between rollers 3050 arranged adjacent to either end of the protective cover. At least one roller 3050 may be connected to a motor 3060 for driving the roller. The motor 3060 may be connected to a micro-controller/microprocessor 3070 for controlling the motor and other functions. A contact sensor 3080 and a dirt sensor 3100 may further be connected the microprocessor 3070. A power supply 3090 supplies power to the microprocessor 3070 and motor 3060. Rollers 3050, motor 3060, microprocessor 3070, power supply 3090, contact sensor 3080 and dirt sensor 3100 may located below an upper surface of the floor covering 1010 and not generally visible. It is noted that at least some of the foregoing elements may not necessarily be incorporated within the floor covering as shown in FIG. 3. For example, the motor, microprocessor and power supply could be external to the floor covering.

The device may be configured to advance at least a portion of the material 3040, by causing one of the rollers 3050 to rotate and thereby collect a portion of the material. This may be done manually, by, for example, using a shaft and lever that can be operated externally to the floor covering to crank a roller, or a knob connected to the roller to rotate the roller. Alternatively, the material could be advanced automatically by motor 3060 under the control of the microprocessor 3070. For example, the microprocessor 3070 could be programmed to send an "activate" or "rotate" signal or the like to the motor 3060 at predetermined time intervals. Upon receiving the signal, the motor 3060 would drive a roller 3050 by a predetermined amount. For example, the predetermined amount would cause the roller to rotate a number of turns that would collect all of the protective material 3040 that had been in place over the protective cover and thus exposed to foot traffic and environmental dirt for a predetermined period of time. This would in turn cause a new and as yet unexposed section of the protective material to be drawn over the protective cover. In this way, dirt that could be obscuring the display would be removed from over the display, allowing it to be more clearly viewed.

Alternatively, advancement of the protective material could be triggered by a signal from the dirt sensor 3100, which could be located below the protective cover 1030 and measure a degree of dirtiness of the protective cover. The dirt sensor 3100 could be, for example, a transmission measurement device that uses photodiodes and/or phototransistors to determine how dirty the protective material over the display is by measurement the loss of light transmission that would occur with the accumulation of dirt on the protective material. When the loss of transmission reached a predetermined level, the dirt sensor 3100 would send a signal to the microprocessor 3070, which in response would activate the roller 3050 to cause it to advance the protective material 3040 by a predetermined amount. The dirt sensor could be a passive device that relies on ambient light being transmitted through the protective material and the protective cover. It could also be an active sensor that transmits light through the protective material and measures the attenuation of the light as it passes through the protective material. Additionally, the active sensor could also operate based on reflected light that reflects back to the sensor as a result of dirt accumulated on the protective material.

In any of the methods of automatic advancement described above, the contact sensor 3080 could be used to prevent automatic advancement when a person was standing or walking on the protective cover 1030, since this could present a trip hazard. The contact sensor 3080 could be, for example, a pressure sensitive sensor located below the protective cover 1030. Upon detecting pressure on the protective cover, the contact sensor would send a signal to the microprocessor 3070. In response, automatic advancement of the roll of protective material would be inhibited by the microprocessor until the contact sensor indicated that the pressure was no longer present. In embodiments, it may be desirable to include proximity sensors (not shown) as well as pressure sensors, to determine if a person is approaching the floor covering prior to commencing with the advancement of the protective material.

Figure 4:
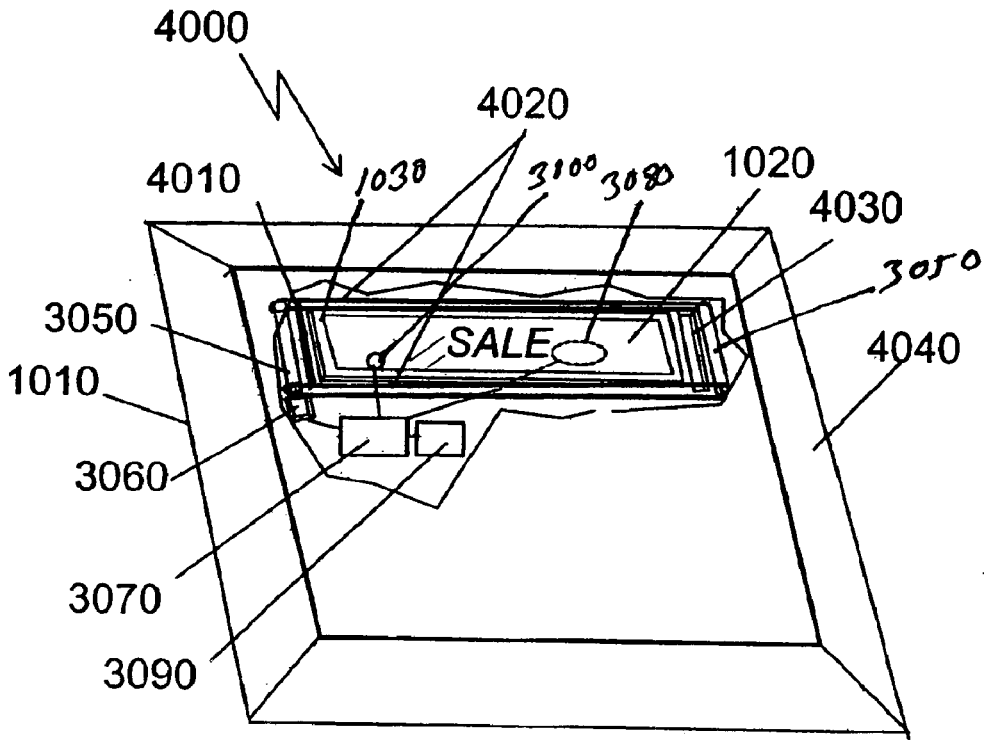
FIG. 4 illustrates an automatic cleaning system for the protective cover according to an embodiment of the present invention.

FIG. 4 shows an apparatus 4000 according to still further embodiments of the invention, in a partial sectional view. As in previously described embodiments, the apparatus 4000 comprises a floor covering 1010, display 1020 and protective cover 1030. The floor covering could have a ramped border 4040, as could any of the previously described embodiments, to make the floor covering easier to walk across or to wheel or slide objects over. The apparatus further comprises a device associated with the protective cover 1030, for at least one of preventing damage to the protective cover and removing dirt from over the electronic display 1020. In the embodiment of FIG. 4, the device is an automated cleaning mechanism comprising a cleaning member 4010. The mechanism is configured to move the cleaning member from a resting position across the protective cover to a predetermined point. The cleaning member 4010 may include a cleaning article such as a brush, a sponge, paper, cloth, a squeegee or the like. The cleaning member 4010 may have a thin, elongated form, and be arranged between tensioning members 4020 for moving the cleaning member across the protective cover. The tensioning members 4020 may be, for example, cables.

Figure 4A:
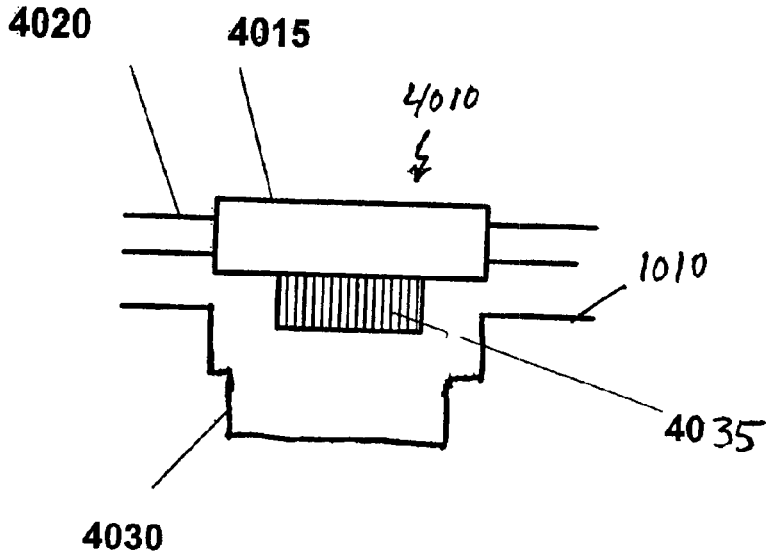
FIG. 4A shows a view of a cleaning member of the automatic cleaning system of FIG. 4.

A cavity or recess 4030 may be formed in the floor covering 1010 adjacent to an end of the protective cover 1030, to receive the cleaning member 4010. FIG. 4A shows an orthogonal view of the cleaning member 4010 along a narrow dimension thereof. As shown in FIG. 4A, the cleaning member 4010 may comprise a backing or housing 4015 retaining or incorporating a cleaning article 4035 such as a brush. The housing could be made of, for example, metal, plastic or wood. Tensioning members 4020 are connected to the housing 4015. The recess 4030 in the floor covering and housing may be formed such that the cleaning member, when received in the recess, is substantially flush with an upper surface of the floor covering 1010, and substantially seals off the recess, which could contain a cleaning agent of some kind, such as Windex ®. Alternatively, the housing 4015 could be very thin so that it is substantially flush with an upper surface of the floor covering when received within the recess.

Figure 4B:
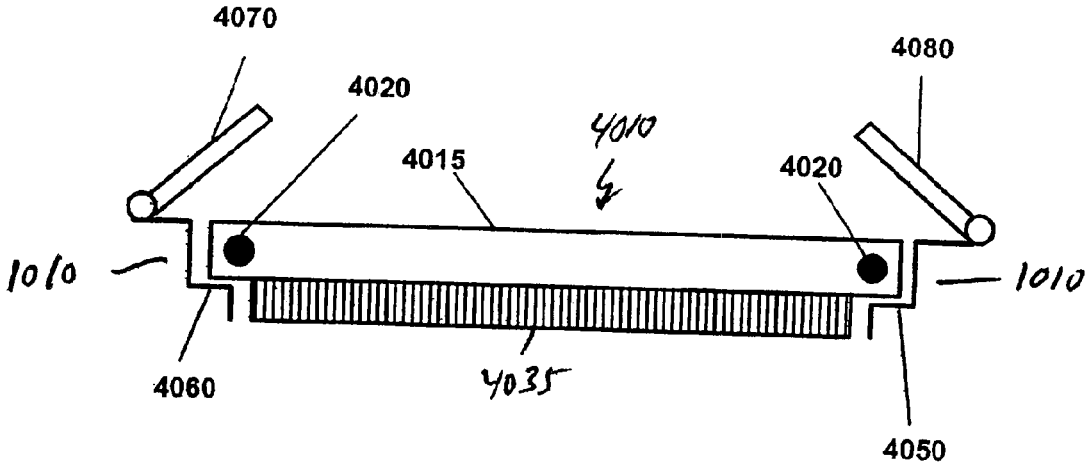
FIG. 4B shows another view of the cleaning member.

FIG. 4B shows the cleaning member 4010 in an orthogonal view along a long dimension thereof. When not received the recess 4030, the cleaning member 4010 may engage tracks 4050, 4060 of the apparatus 4000 and be guided by the tracks when moved across the protective cover 1030 by the tensioning members 4020. The apparatus 4000 may further include movable lids 4070, 4080 which may be opened and closed as described in more detail below.

The tensioning members 4020 may be connected between rollers 3050 as shown in FIG. 4. As in the embodiment of FIG. 3, at least one roller 3050 may be connected to a motor 3060 for driving the roller. The motor 3060 may be connected to a microprocessor 3070 for controlling the motor and other functions. A contact sensor 3080 and a dirt sensor 3100 may further be connected the microprocessor 3070. A power supply 3090 supplies power to the microprocessor 3070 and motor 3060. Rollers 3050, motor 3060, microprocessor 3070, power supply 3090, contact sensor 3080 and dirt sensor 3100 may located below an upper surface of the floor covering 1010 and not generally visible. In embodiments, it may be desirable to include proximity sensors (not shown) as well as pressure sensors, to determine if a person is approaching the floor covering prior to commencing with the cleaning process.

A cleaning operation or cycle of the automated cleaning system of the embodiment of FIG. 4 may be automatically initiated and controlled by the microprocessor 3070. At predetermined time intervals, or possibly upon receiving a signal from the dirt sensor 3100, the microprocessor 3070 would send a signal to the motor 3060 to cause it to drive the roller 3050. The roller 3050 would cause tensioning members 4020 to pull or draw the cleaning member 4010 from a resting position in the recess 4030 and into contact with the upper exposed surface the protective cover 1030. As mentioned earlier, the recess 4030 could contain a cleaning agent that would be absorbed by or transferred onto the cleaning article 4035. The close fit of the housing 4015 within the recess 4030, as described above, could help to slow or prevent evaporation of the cleaning agent.

The motor 3060 would proceed to move the cleaning member 4010 over the upper exposed surface of the protective cover 1030 by means of the tensioning members 4020. The tensioning members would maintain a downward pressure on the cleaning member 4010 as it was moved across the protective cover, causing the cleaning article 4035 imbued with cleaning agent to brush away, wipe away, or otherwise remove dirt from the protective cover. The microprocessor 3070 could be programmed to drive the motor 3060 for a predetermined time or at a predetermined rate such that the cleaning member was moved to a predetermined point; for example, moved across substantially all of the protective cover. The microprocessor could then cause the motor to be driven in the opposite direction to return the cleaning member to its resting position in the recess 4030. Or, for example, a switch could be triggered when the cleaning member reached an end of the protective cover, and signal the microprocessor to cause the motor to return the cleaning member to the recess. It is noted that two motors under the control of the microprocessor could be used to the same end; i.e., one motor could drive a roller at one end of the protective cover to pull the cleaning member from the recess and across the protective member, while a second motor could drive a roller at the other end of the protective cover to return the cleaning member to the recess.

While the protective cover 1030 was not being cleaned as described above, the tensioning members 4020 could be disposed below the upper exposed surface of the protective cover and be covered and concealed by the movable lids 4070, 4080, which would be in a closed position while the protective cover was not being cleaned. However, during the above-described process, the movable lids 4070 and 4080 could be raised to an open position to allow the tensioning members 4020 to rise above the upper exposed surface of the protective cover as the tensioning members move the cleaning member 4010 over the surface. When the cleaning member was returned to the recess, the movable lids could be returned to closed position. The movable lids could be controlled by the initial rotation of the motor 3060 driving the roller 3050. For example, the rotation of motor 3060 as it pulls the cleaning member from the recess could also move the lids to the open position, and the return of the cleaning member to the recess could trigger a lever or other action that moves the lids to the closed position. Alternatively, the lids could be operated by a separate motor.

As in the embodiment of FIG. 3, the contact sensor 3080 could signal the presence of a person or other object on the protective cover, and in response the microprocessor would inhibit the automated cleaning operation to reduce a trip hazard. A motion detector arranged in or in the proximity of the apparatus could also be used to signal the microprocessor that people were near and that a cleaning operation should be inhibited. The microprocessor could also be connected to an audio device to sound an audible warning that a cleaning operation was underway, and the electronic display could similarly be controlled by the microprocessor to display a visual warning message. Such warning signals could also be used in connection with the automatic advancement device described with reference to FIG. 3.

Figure 5:
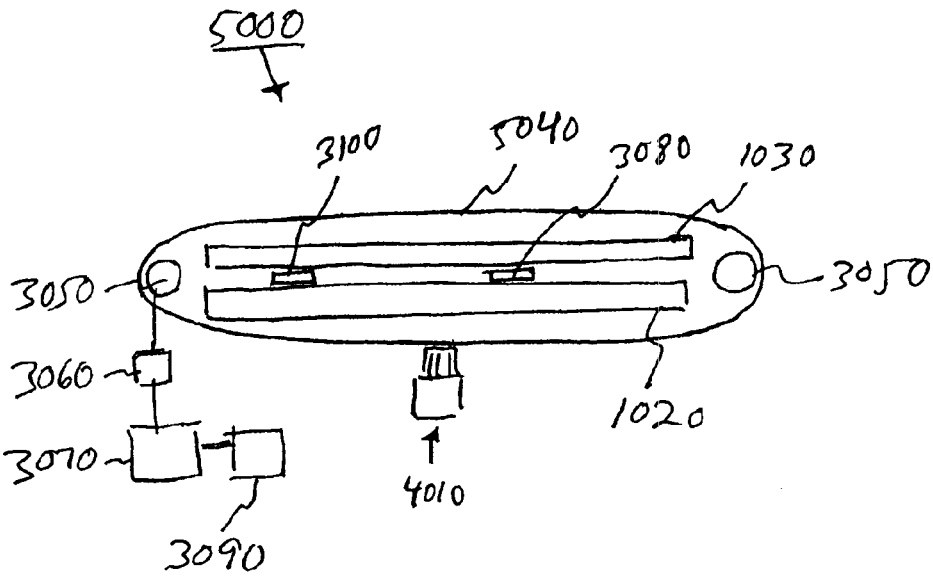
FIG. 5 shows a variation of an automatic cleaning system for the protective cover according to an embodiment of the present invention.

FIG. 5 shows still another embodiment of the present invention. Apparatus 5000 comprises at least an electronic display 1020 and a protective cover 1030 as described above with reference to other embodiments, and may further comprise rollers 3050, a motor 3060, a microprocessor 3070, a power supply 3090, a dirt sensor 3100, a contact sensor 3080 and a cleaning member 4010 as also described earlier. In the embodiment of FIG. 5, a loop of protective material 5040 is arranged to at least partly encircle the electronic display and the protective cover. The cleaning member 4010 is arranged to contact a section of the loop 5040 below the electronic display. The microprocessor 3070 may be configured to automatically activate the motor 3060 to drive a roller 3050 to cause the loop 5040 to rotate at predetermined time intervals or upon a signal from the dirt sensor 3100, to clean the section by passing it across the cleaning member 4010. As the loop rotates, the section cleaned by the cleaning member during the previous rotation is positioned over the protective cover.

Figure 6:
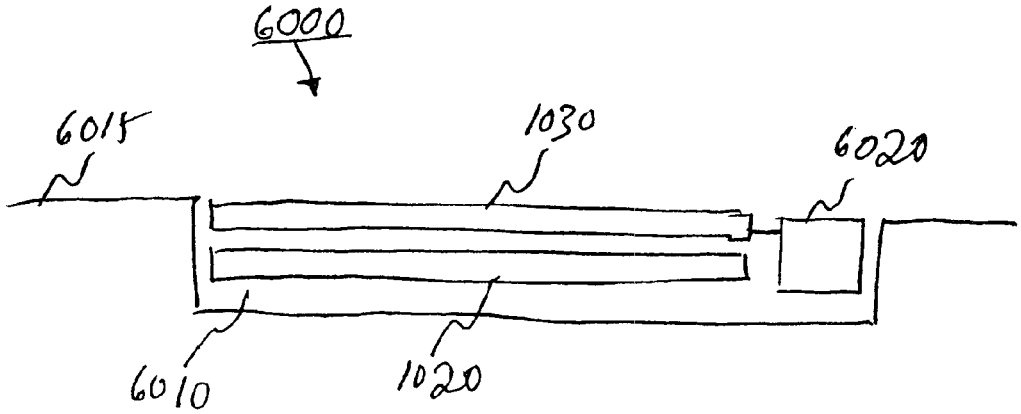
FIG. 6 illustrates how embodiments of the present invention may be associated with a recess in a floor.

FIG. 6 illustrates that the device associated with the protective cover, for at least one of preventing damage to the protective cover and removing dirt from over the electronic display, as described above with reference to other embodiments, need not necessarily be associated with a floor covering, movable, affixed to a floor, or otherwise. Instead, an apparatus 6000 as shown in FIG. 6 could comprise an electronic display 1020 and a protective cover 1030 configured to be received at least partly within a recess 6010 of a floor 6015. Device 6020 could be any one of the devices described earlier for at least one of preventing damage to the protective cover and removing dirt from over the electronic display.

Several embodiments of the present invention are specifically illustrated and described herein. However, it will be appreciated that modifications and variations of the present invention are covered by the above teachings and within the purview of the appended claims without departing from the spirit and intended scope of the invention.

What is claimed is:

1. An apparatus, comprising:

an electronic display associated with a floor, the electronic display device configurable to display an electronically modifiable verbal message;

a protective cover for the electronic display; and a device associated with the protective cover, for at least one of preventing damage to the protective cover and removing dirt from over the electronic display.

2. The apparatus of claim 1, wherein the device comprises a sheet formed from a protective material.

3. The apparatus of claim 2, wherein the sheet is configured to adhere to the protective cover.

4. The apparatus of claim 2, wherein the material is plastic.

5. The apparatus of claim 1, wherein the device comprises continuous roll of protective material arranged over a surface of the protective cover.

6. The apparatus of claim 5, wherein the device is configure to advance at least a portion of the material.

7. The apparatus of claim 6, wherein the device is configure to automatically advance the material.

8. The apparatus of claim 6, wherein device is configured to enable manual advancement of the material.

9. The apparatus of claim 6, further comprising a contact sensor to detect the presence of a person in contact with the apparatus.

10. The apparatus of claim 9, wherein the device is configure to inhibit automatic advancement of the material when the contact sensor detects a person in contact with the apparatus.

11. The apparatus of claim 5, wherein the material is plastic.

12. The apparatus of claim 1, further comprising a dirt sensor for measuring a degree of dirtiness associated with the electronic display.

13. The apparatus of claim 12, wherein the dirt sensor comprises a transmission device for measuring a dirt accumulation.

14. The apparatus of claim 1, wherein the device is an automated cleaning mechanism.

15. The apparatus of claim 14, wherein the mechanism comprises a cleaning member.

16. The apparatus of claim 15, wherein the cleaning member is formed as a thin, elongated member.

17. The apparatus of claim 15, wherein the cleaning member includes at least one of a brush, a sponge, paper, cloth and a squeegee.

18. The apparatus of claim 15, wherein the cleaning member is configured to be received within a recess in a floor covering.

19. The apparatus of claim 15, wherein the cleaning member is arranged between tensioning members for moving the cleaning member across the protective cover.

20. The apparatus of claim 19, wherein the tensioning members are coupled to a motor for moving the tensioning members.

21. The apparatus of claim 15, further including tracks configured to engage the cleaning member, to guide the cleaning member as it is moved across the protective cover.

22. The apparatus of claim 14, wherein the mechanism is configured to move a cleaning member from a resting position across the protective cover to a predetermined point.

23. The apparatus of claim 22, wherein the mechanism is further configured to return the cleaning member to the resting position.

24. The apparatus of claim 14, wherein the mechanism is configured to automatically activate a cleaning operation comprising moving a cleaning member across the protective cover.

25. The apparatus of claim 24, comprising a sensor for detecting the presence of a person near or on the apparatus, to prevent the mechanism from automatically activating the cleaning operation.

26. The apparatus of claim 24, further comprising a processor for controlling the mechanism to perform the cleaning operation at predetermined times.

27. The apparatus of claim 24, further comprising a dirt sensor for measuring a dirt accumulation associated with the electronic display.

28. The apparatus of claim 1, the device comprising:

a loop of protective material arranged to at least partly encircle the electronic display and the protective cover;

a cleaning member arranged to contact a section of the loop below the electronic display; and a mechanism for causing the loop to rotate, to clean the section by passing it across the cleaning member.

29. The apparatus of claim 28, wherein the mechanism is configured to automatically rotate the loop to position the cleaned section over the protective cover and clean a different section by passing it across the cleaning member.

30. The apparatus of claim 28, wherein the mechanism is configured to automatically rotate the loop at predetermined time intervals.

31. The apparatus of claim 1, wherein the device comprises a plurality of separable sheets formed from a protective material.

* * * * *